United States Patent [19]

Tanaka

[11] Patent Number: 4,837,938

[45] Date of Patent: Jun. 13, 1989

[54] SCALE BALANCING DEVICE IN DRAWING MACHINE

[75] Inventor: Masahiro Tanaka, Tokyo, Japan

[73] Assignee: Asahi Seimitsu Kabushiki Kaisha, Tokyo, Japan

[21] Appl. No.: 116,237

[22] Filed: Nov. 3, 1987

[30] Foreign Application Priority Data

Nov. 5, 1986 [JP] Japan ..... 61-262944

[51] Int. Cl.[4] ..... B43L 13/02

[52] U.S. Cl. ..... 33/438

[58] Field of Search ..... 33/438, 439, 440, 430, 33/498

[56] References Cited

U.S. PATENT DOCUMENTS

| | | | |
|---|---|---|---|
| 4,070,758 | 1/1978 | Watanabe | 33/438 |
| 4,578,872 | 4/1986 | Yoshida et al. | 33/438 |
| 4,580,351 | 4/1986 | Yoshida | 33/438 |
| 4,587,742 | 5/1986 | Yoshida | 33/438 |
| 4,601,107 | 7/1986 | Yoshida | 33/438 |

*Primary Examiner*—William D. Martin, Jr.

*Attorney, Agent, or Firm*—Birch, Stewart, Kolasch & Birch

[57] ABSTRACT

In a scale balancing device, a rotating moment balancing a moment developed by the dead load of the scale is exerted by the tension member having tensile elasticity upon the rotatable member adapted to be rotated concentrically and integrally with the scale rotating shaft while the tensile elasticity of the tension member is applied through the biasing mechanism to the same rotatable member and thereby to balance the tensile elasticity of the tension member to that the unbalanced load developing in the scale rotating shaft as a result of balancing of the scale may be balanced or reduced. Furthermore, by position-adjustment of the engaging member in the direction of the radius of the rotatable member with respect to its rotational center, a scale balancing force is easily adjusted to accommodate the inclination of the drawing board from the horizontal to the vertical or to accommodate an exchange of the scales having different weights.

19 Claims, 6 Drawing Sheets

SCALE BALANCING DEVICE IN DRAWING MACHINE

BACKGROUND OF THE INVENTION

The present invention relates to an improved scale balancing device incorporated into a scale manipulating head of the universal parallel ruler (drawing machine).

In the scale manipulating head of the drawing machine, an arrangement is generally provided such that the scale rotating shaft is rotatably supported in the bearing of the scale supporting base plate. The scale rotating shaft has the scale manipulating handle and the scale mounting plate both formed integrally therewith at the upper end and the lower end, respectively, so that said scale manipulating handle may be used to rotate the scale. In such an arrangement, due to the fact that the scale extends in one direction from its rotating shaft in a cantilever fashion, an empty weight or dead load of the scale produces an unbalanced load which is disadvantageously applied to the scale rotating shaft so far as the scale is free to be rotated, when the drawing board is installed at an angle. A rotating moment due to such empty weight of the scale is zero when the center of gravity of the scale is vertically just above the manipulating handle and when said center of gravity is vertically just below said manipulating handle while said rotating moment gradually increases as the center of gravity of the scale is rotated from siad position just above the manipulating handle to the horizontal and at this moment said rotating moment reaches its maximum value. As said center of gravity is further rotated from the horizontal to said position vertically just below the manipulating handle, said rotating moment due to the empty weight gradually decreases down to zero. Accordingly, the scale would be unintentionally rotated downwardly due to said empty weight of the scale unless the scale is positively supported by the scale manipulating handle. It is an essential object of the present invention to balance such rotating moment produced due to the empty weight of the scale so that the scale may be held at any desired angular position and the rotational manipulation of the scale may be smoothly achieved, by providing an improved scale balancing device.

Such a prior art device is disclosed by publications such as Japan Unexamined Patent Publication No. 59-179400 and Japan Unexamined Patent Publication No. 60-149496.

In this device of well known art, in order to avoid the inconvenience that, when the rotating moment developed by the empty weight of the scale is balanced by a balancing mechanism concentrically mounted on the scale rotating shaft, an unbalanced load is exerted on the scale rotating shaft to produce an error in the scale rotation angle, the first rotatable member adapted to be rotated concentricallty with the scale rotating shaft is coupled through the interlocking mechanism to the second rotatable member separately provided on the non-rotatable member of the scale manipulating head so that the first and second rotatable members may be rotated synchronously with each other and thereby a tensile force against the rotating moment due to the empty weight of the scale is exerted on said second rotatable member in order to maintain the scale well balanced.

With this prior art device, however, the design of the non-rotatable member included in the head of the conventional universal parallel ruler must be substantially modified, since the second rotatable member of the same size as the first rotatable member must be incorporated into the non-rotatable member. This prior art device is accompanied with further problems in that the non-rotatable member inevitably becomes bulky, it is impractical to perfectly remove the unbalanced load in order to balance the rotating moment due to the empty weight of the scale, and finally the interlocking mechanism serving to achieve a synchronoue rotation of the first and second rotatable members causes an error in the rotational angle of the scale rotating shaft.

SUMMARY OF THE INVENTION

A primary object of the present invention is, in view of various drawbacks of the conventionl device as mentioned above, to provide an improved scale balancing device in the drawing machine, said scale balancing device being constructed with a rotatable member being rotatable concentrically and integrally with a scale rotating shaft in a scale manipulating head and being provided with an engaging member which is position-adjustable in a direction of the radius of said rotatable member, a tension member having a tensile elasticity is connected at one end with said engaging member and at the other end to one end of a biasing mechanism mounted on a non-rotatable member, and the other end of the biasing mechanism is held in contact with the rotatable member against the tensile elasticity of the tension member.

It is another object of the present invention to provide said scale balancing device in the universal parallel ruler wherein the engaging member is position-adjustable in the direction of the radius of the rotatable member with respect to its rotational center.

It is a further object of the present invention to provide the scale balancing device in the universal parallel ruler characterized in that a locking force provided by a combination of grooves formed in an indexing plate included in an indexing mechanism and an indexing detent adapted to be received in said grooves to lock the scale at predetermined angular intervals can be mentioned under action of the scale balancing force.

It is still another object of the present invention to provide the scale balancing device in the universal parallel ruler characterized in that a lever of the indexing mechanism provided along the scale rotating shaft in order to lock the scale at predetermined angular intervals is bent so that said lever may operate without any mechanical interference of said engaging member.

As has previously been mentioned, with a slanted drawing board, the rotating moment developed by the empty weight of the scale becomes zero when the scale is vertically oriented, and gradually increases as the scale is rotated from this vertical upper position to the horizontal position at which said rotating moment reaches the maximum. This rotating moment gradually decreases as the scale is rotated from the horizontal position to the vertical lower position. In the scale balancing device constructed in accordance with the present invention, a rotating moment balancing such rotating moment developed by the dead load of the scale is exerted by the tension member having a tensile elasticity upon the rotatable member adapted to be rotated concentrically and integrally with the scale rotating shaft while the tensile elasticity of said tension member is applied through the biasing mechanism to the same rotatable member and thereby to balance said tensile elasticity of the tension member so that the unbalanced load developing in the scale rotating shaft as a result of the scale balancing may be balanced or reduced. Furthermore, by position-adjustment of the engaging member in the direction of the radius of the rotatable member with respect to its rotational center, a scale balancing force is easily adjusted to accommodate the inclination of the drawing board from the horizontal to the vertical or exchange of the scales of different weight. For example, when the engaging member is positioned at the center of the scale rotating shaft, the tensiion spring cannot prevent the scale from being rotated and, as the engaging member is moved away from the scale rotating shaft, the elasticity of the tension spring acting upon the rotatable member correspondingly increases. Conveniently, the scale balancing device of the invention has another important feature in that the force provided from the combination of the grooves formed in the indexing plate of the indexing mechanism with te indexing detent of said mechanism adapted to be received in a selected one of said grooves in order to lock the scale at the predetermined angular intervals is so adjusted as to be maintained by the scale balancing force. This feature allows the width and the depth of said grooves as well as the engaging force of said detent to be minimized. For example, it is easily achieved to reduce the indexing angular interval which has usually been 15° to 5° and also to reduce the thickness of the indexing plate as well as the engaging strength of the detent.

As still another important feature of the scale balancing device constructed in accordance with the present invention, the lever of the indexing mechanism provided along the scale rotating shaft in order to lock the scale at the predetermined angular intervals is so bent that said lever may operate without any mechanical interference of said engaging member. This feature allows the universal parallel ruler to be provided in which the lever of the indexing mechanism and the engaging member of the scale balancing device mounted around the scale rotating shaft can effectively operate without any mechanical interference with each other.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF EMBODIMENTS

Figure 1:
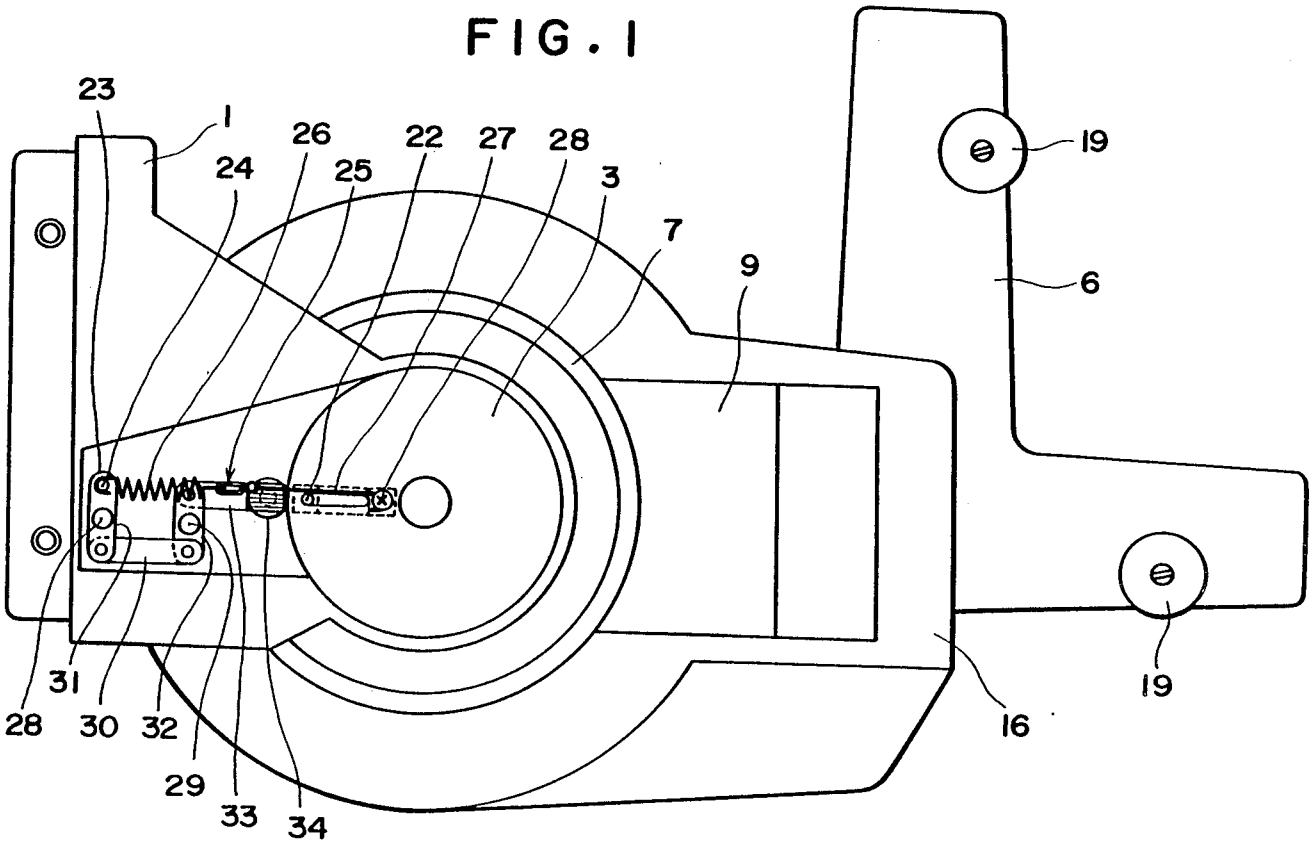
FIG. 1 is a schematic plan view illustrating an important part in an embodiment of the device constructed according to the present invention.
Figure 2:
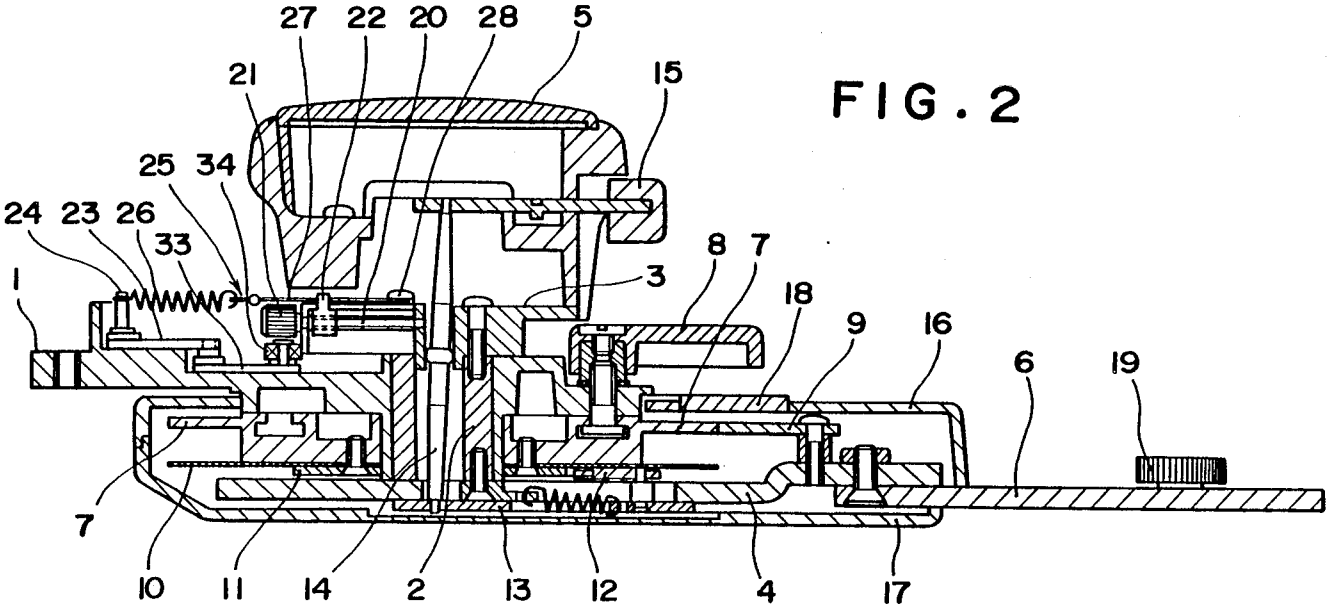
FIG. 2 is a front sectional view of said important part.

A scale balancing device of the present invention will be described more in detail, by way of example, with reference to the accompanying drawings. Referring to FIGS. 1 and 2, reference numeral 1 designates a non-rotatable member of this invention serving as a bearing base plate for a scale manipulating head connected to a member such as a cursor or a pully-carriage which is movable parallel to the top surface of the drawing board. A bearing of this bearing base plate 1 rotatably supports a hollow shaft 2. A rotatable member 3 of this invention is integrally secured to an upper portion of the shaft 2 by screws and a scale supporting base plate 4 is integrally secured to a lower portion of shaft 2 also by screws. The rotatable member 3 has a scale manipulating handle 5 integrally secured thereto at its upper portion and the scale supporting base plate 4 has a scale mounting plate 6 secured to a front end thereof so that said handle 5 may rotate the scale carried by the scale mounting plate 6. A protractor 7 adapted to be clamped to the bearing base plate 1 by use of a clamping lever 8 when necessary is rotatably mounted to the bearing in alignment with a vernier 9 secured to the scale supporting base plate 4. The protractor 7 further includes a scale clamping plate 10 and an index plate 11 both integrally secured thereto. The scale clamping plate 10 can be clamped to the scale supporting base plate 4 by use of the scale clamping lever whenever necessary in a manner not shown. The index plate 11 includes grooves formed at equiangular intervals therein so that an index detent 12 is engaged into any one of said grooves and thereby said index plate 11 is fixed with respect to the scale supporting base plate 4. The index detent 12 is operatively associated with an interlocking piece 13 being movable along a bottom surface of the scale supporting base plate 4, a lever 14 extending through the interiors of the shaft 2 and the rotatable member 3, respectively, and a lever 15 provided laterally of the handle 5 so as to be selectively engaged with and disengaged from the index plate 11. Reference numerals 16, 17 designate covers adapted to be rotatable integrally with the scale mounting plate 6 and a portion of the cover 16 which overlines the vernier 9 is provided with a loupe 18. Reference numeral 19 designates a scale mounting screw.

The rotatable member 3 according to the present invention includes a threaded shaft 20 with a radially extending axis which can be rotated by a manipulating knob 21, and an engaging piece 22 adapted to be engaged with said threaded shaft 20 in a radially movable fashion. In the embodiment as shown, the threaded shaft 20 is provided within the cavity of the rotatable member 3 and adapted to be engaged with the engaging piece 22 within said cavity. A pin-like projection of the engaging piece 22 extends upwardly through an elongated slot formed in the rotatable member 3 and is free to reciprocate between a position adjacent the rotational center of the rotatable member 3 and a remote position as the threaded shaft 20 is rotated. An end 24 of a biasing mechanism 23 according to the present invention projects upwardly from the bearing base plate 1 at a point on an extension of the threaded shaft 20 and there is provided a tension member 25 having a tensile elasticity between said end 24 and said engaging member 22.

In the embodiment as shown, the tension member 25 comprises a tension spring 26 and a wire 27 which is anchored by a wire anchoring member 28 projecting from the rotatable member 3 at a point adjacent the rotational center thereof so that the pin-like projection of the engaging member 22 adapted to be rotated as the rotatable member 3 is rotated comes into engagement with an intermediate portion of the wire 27 and thereby pulls the tension member 25 with a tensile force corresponding to a rotation radius of said projection. While the biasing mechanism 23 may be of a simple structure, namely, a rod-like one-piece member being controllably movable along the longitudinal direction of the threaded shaft 20, which bears against a side of the rotatable member 3 at one end and is engaged with the the tension member 25 at the other end, the biasing mechanism 23 according to the present embodiment comprises a linkage mechanism. This linkage mechanism includes a pair of interlocking levers 31, 32 actuated by a link lever 30 to be pivotally moved in parallel with each other around pivots 28, 29, respectively, a biasing lever 33 mounted on an end of the interlocing lever 32 so as to be movable along the threded shaft 20, a roller 34 provided on a front end of said biasing lever 33 so as to be maintained bearing against the periphery of the rotatable member 3, and the tension member 25 anchored at an end of the interlocking lever 31 so that the tensile elasticity of the tension member 25 may be exerted on the rotatable member 3.

Figure 3:
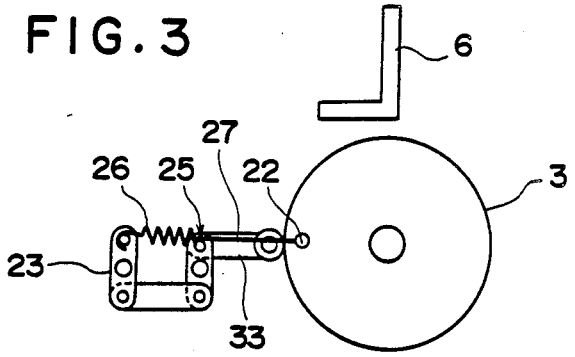
FIGS. 3 through 5 are schematic diagrams sequentially illustrating a manner in which said important part operates.
Figure 4:
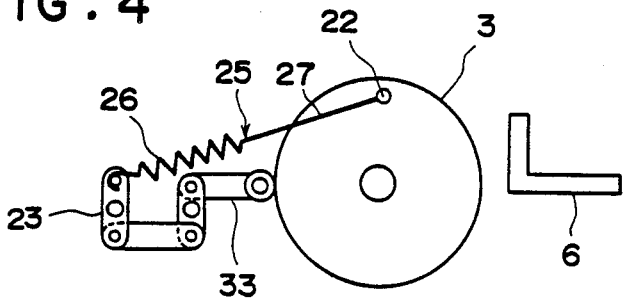
Figure 5:
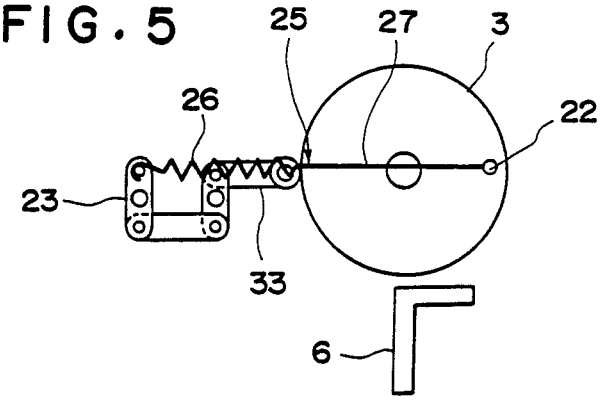
Figure 6:
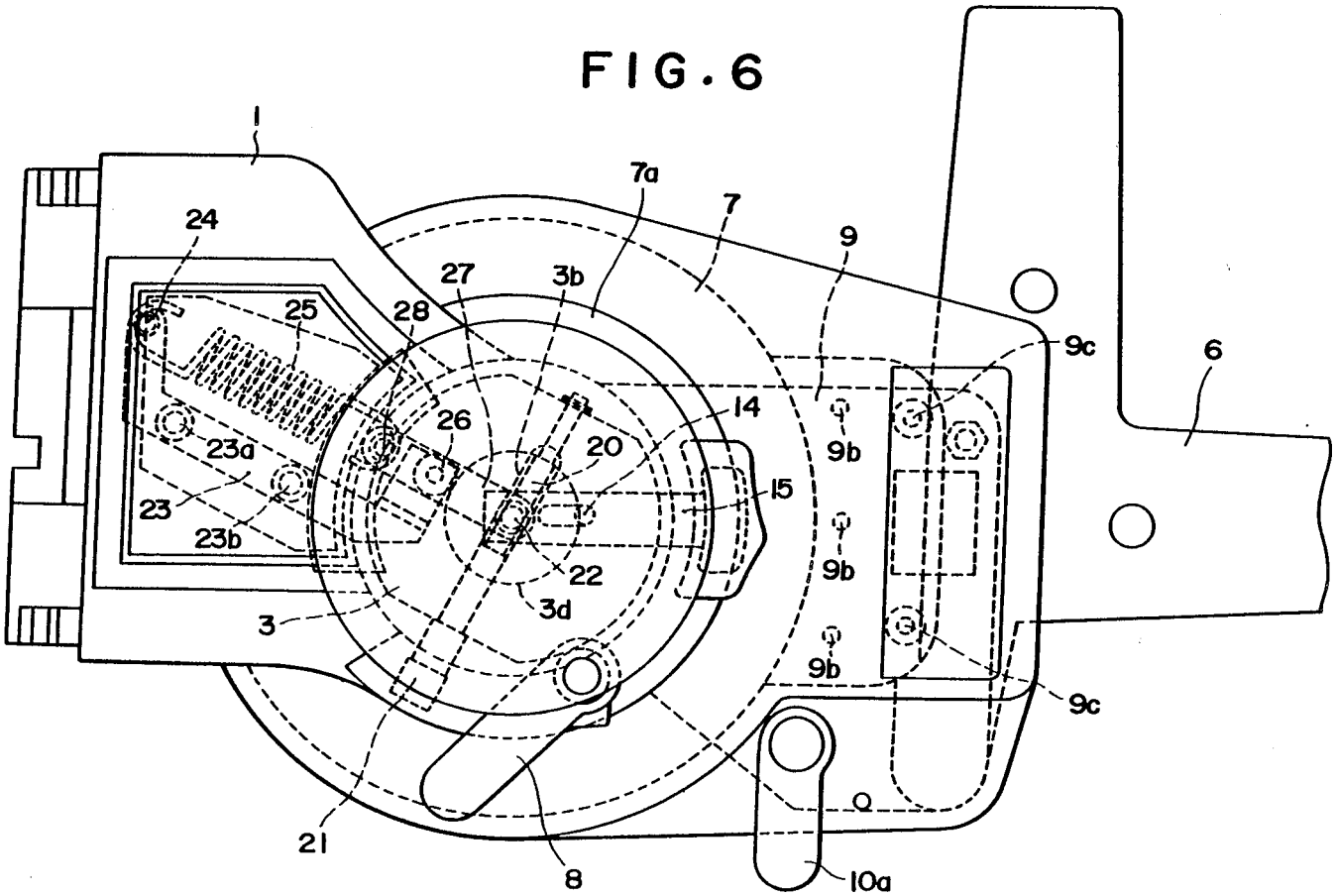
FIG. 6 is a schematic plan view illustrating an important part in another embodiment of the device constructed according to the present invention.
Figure 7:
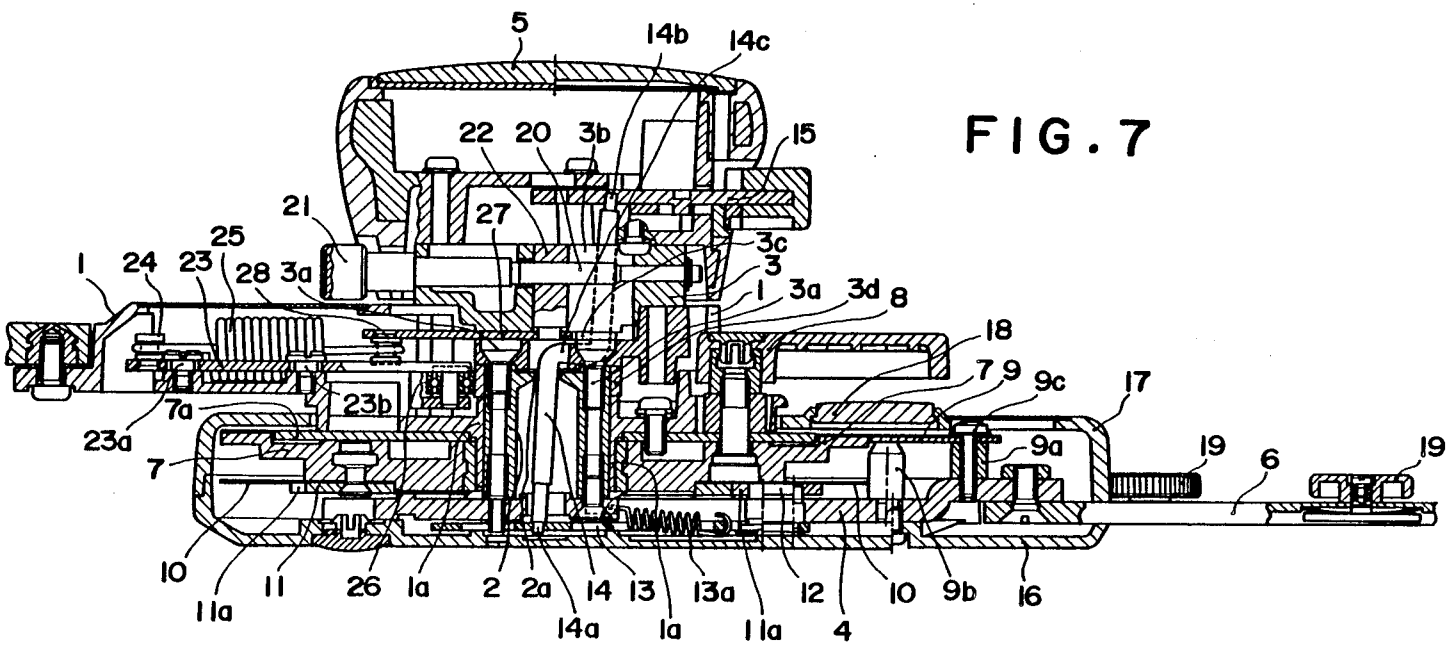
FIG. 7 is a front sectional view of the important part shown in FIG. 6.

The engaging member 22 of the rotatable member 3 which is rotated in unison with said scale (or the scale mounting plate 6), the tension member 25, and the biasing lebver 33 of the biasing mechanism 23 are relatively positioned to one another sequentially illustrated by FIGS. 3 through 5. Specifically, when the center of gravity of the scale is vertically just above the rotatable member, the engaging member 22 occupies a position on the radius of the rotatable member 3 nearest the tension member 25 as shown in FIG. 3. The tension member 25 and the biasing lever 33 are positioned along a straight line passing through the rotational center of the rotatable member 3, the tensile elasticity of the tension member 25 exerts no rotating moment on the rotatable member 3 and thus, in this situation, the scale is balanced with zero rotating moment due to the dead weight of the scale 6. As the scale is rotated together with the engaging member 22 from said vertical position to the horizontal position as shown in FIG. 4 by an angle of 90°, the tension member 25 gradually increases a tension angle around a pivot at which the tension member 25 is connected to the biasing mechanism 23 from the previous position as shown in FIG. 3, exerting upon the rotatable member 3 a rotating moment against the moment due to the dead weight of the scale. Both the tension angle and the rotating moment exerted on the rotatable member 3 reach their maximum values in the situation shown by FIG. 4 in which the center of gravity of the scale is on the horizontal, balancing the rotating moment due to the dead weight shown in the scale. In this situation, the biasing lever 33 radially applies the tensile elasticity of the tension member 25 on the periphery of the rotatable member 3 so that any unbalanced load possibly exerted on the rotatable member 3 may be effectively reduced. As the scale is subsequently rotated from the horizontal position to the vertical position just below the rotatable member, the tension angle of the tension member 25 gradually decreases. At the position shown in FIG. 5 in which the center of gravity of the scale has reached said position just below the rotatable member, the engaging member 22 is in the remotest position but the tension member 25 and the biasing lever 33 are on a line along the diameter of the rotatable member 3 so that the tensile elasticity of the tension member 25 is balanced. No rotating moment is exerted upon the rotatable member 3 and this condition is balanced with the condition of zero rotating moment due to the dead weight of the scale 6.

Now another embodiment of the scale balancing device constructed in accordance with the present invention will be described in detail with reference with FIGS. 6 through 10. Reference numeral 1 designates a non-rotatable member of this invention serving as a bearing base plate for a scale manipulating head connected to a member such as a cursor or a pulley-carriage which is movable parallel to the top surface of the drawing board. A bearing 1*a* of this bearing base plate 1 rotatably supports a hollow shaft 2. A rotatable member 3 of this invention is integrally secured to an upper portion of the shaft 2 by screws 3*a* and a scale supporting base plate 4 is integrally secured to a lower portion of the shaft 2 by screws 4*a*. It should be noted here that the shaft 2 and the rotatable member 3 are integral with each other so far as their rotary functions are concerned. Accordingly, it is unnecessary to distinguish the shaft 2 from the rotatable member 3 and the term "rotatable member" should be considered to be a member including said shaft 2. The rotatable member 3 has a scale manipulating handle 5 integrally secured thereto at its upper portion and the scale supporting base plate 4 has a scale mounting plate 6 secured to a front end thereof so that handle 5 may rotate the scale carried by the scale mounting plate 6. A protractor 7 adapted to be clamped to the bearing base plate 1 by use of a clamping lever 8 is rotatably mounted around the lower portion of the bearing 1*a* so that protractor graduations provided on the periphery of said protractor may correspond to vernier graduations on a vernier 9 mounted by screws 9*c* on the scale supporting base plate 4 with interposition of spacers 9*a*, 9*b*. Reference numeral 7*a* designates a protractor base line index plate integrally mounted on the supporting base plate 1 in opposition to the inner periphery of the protractor graduations on the protractor 7 so that a rotational angle of the protractor 7 relative to the supporting base plate 1 may be recognized by this protractor base line index plate 7*a*. The protractor 7 further includes a scale clamping plate 10 and an index plate 11 both integrally secured thereto. The scale clamping plate 10 can be clamped to the scale supporting base plate 4 by use of a scale clamping lever 10*a* whenever necessary. The index plate 11 includes grooves 11*a* formed therein at equiangular intervals so that an index detent 12 is engaged into any one of said grooves and thereby said index plate 11 is fixed with respect to the scale supporting base plate 4. A width of each groove 11*a* formed in the index plate 11 and a groove interval may be reduced aproximately to the minimum thickness of the index plate 11 for effective punching. For example, the conventional angular interval of these grooves which is typically 15° may be reduced to 5° or less. An engaging strength of the grooves 11*a* and the index detent 12 may be set to a level such that a disengagement occurs when a load due to the dead weight of the scale reaches the maximum. The index 12 is operatively associated with an interlocking piece 13 being movable along a bottom surface of the scale supporting base plate 4, a lever 14 extending through the interiors of the shaft 2 and the rotatable member 3, respectively, and a lever 15 provided laterally of the handle 5 so as to be selectively engaged with and disengaged from the index plate 11. The lever 14 is engaged at its lower end 14*a* with the interlocking piece 13 and at its upper end 14*b* with the lever 15. Reference numeral 13*a* designates a spring member always exerting a tensile elasticity upon the interlocking piece 13 so as to urge said index detent 12 into engagement with any one of said grooves 11*a*. Said lever 14 has a bent portion 14*c* adjacent its upper end, being pivotally movable on a diameter-reduced portion 2*a* provided inside the upper portion of the shaft 2, and is engaged with the lever 15. Reference numerals 16, 17 designate covers adapted to be rotatable integrally with the scale mounting plate 6 and a portion of the cover 16 which overlies the vernier 9 is provided with a loupe 18. Reference numeral 19 designates a scale mounting screw.

The rotatable member 3 according to the present invention includes a threaded shaft 20 with a radially extending axis which can be rotated by a manipulating knob 21, and an engaging member 22 adapted to be engaged with said threaded shaft 20 in a radially movable fashion. In the embodiment as shown, the threaded shaft 20 is provided within a guide frame 3*b* inside the rotatable member 3 and adapted to be engaged with the engaging member 22. Thus, the engaging member 22 is free to reciprocate radially between a position adjacent the rotational center of the rotatable member 3 and a remote position as the threaded shaft 20 is rotated. A front end of a link member 27 extending through a lateral opening 3*c* of te rotatable member 3 is connected to the lower end of the engaging member 22 and a spring anchoring means 28 is provided on a rear end of said link member 27. An end 24 of a biasing mechanism 23 according to the present invention projects from the bearing base plate 1 at a point along a line extending transversely of the threaded shaft 20 and there is connected between said end 24 and the spring anchoring means 28 of said link member 27 a tension member 25 having a tensile elasticity.

In this embodiment, the tension member 25 comprises a coil spring adapted to be tensioned by the engaging member 22 throught the link member 27 so that a tensile force thereof depending on a rotational radius of the engaging member 22 which is rotated as the rotatable member 3 may be applied to the biasing mechanism 23. The biasing mechanism 23 comprises an one-piece member in the form of a bent rod extending longitudinally of the tension member 25 and having its movement limited by guide pins 23*a*, 23*b*. An end of the biasing mechanism 23 is bent downwardly and terminates in a rotatable contact member 26 such as a bearing which is, in turn, radially biased against a contact ring 3*d* forming a lower side portion of the rotatable member 3.

Figure 8:
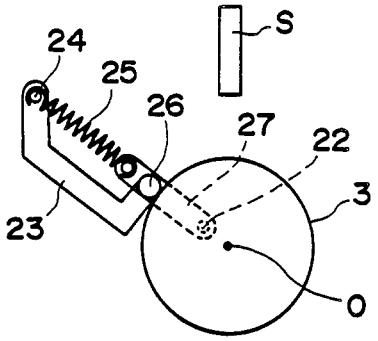
FIGS. 8 through 10 are schematic diagrams sequentially illustrating a manner in which the important part shown by FIG. 7 operates.
Figure 9:
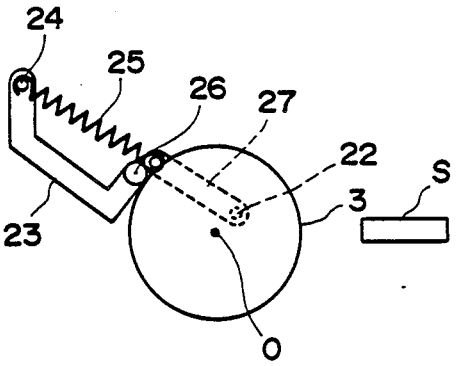
Figure 10:
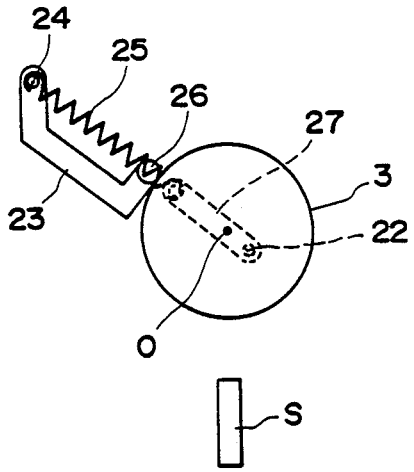

The engaging member 22 of the rotatable member 3 being rotatable in unison with said scale (the scale mounting plate 6) and the tension member 25 are relatively positioned to each other as sequentially illustrated by FIGS. 8 through 10. More specifically, when the center of gravity of the scale S is vertically just above the rotatable member and no rotating moment due to the empty weight of the scale is applied to the rotatable member 3, the engaging member 22 occupies a position on the radius of the rotatable member 3 nearest the tension member 25 as seen in FIG. 8 in which the tension member 25 and the contact member 26 are positioned along a straight line passing through the rotational center 0 of the rotatable member 3, the tensile elasticity of the tension member 25 exerts no rotating moment on the rotatable member 3 and in such a situation, the scale is balanced with zero rotating moment due to the dead weight of the scale S. As the scale is rotated together with the engaging member 22 from said vertical position to the horizontal position as seen in FIG. 9 by an angle of 90°, the tension member 25 gradually increases a tension angle around a joint 24 at which the tension member 25 is connected to the biasing mechanism 23 from the previous position as shown by FIG. 8, exerting upon the rotatable member 3 a rotating moment against the moment due to the dead weight of the scale. Both the tension angle and the rotating moment exerted on the rotatable member 3 reach their maximum values in the situation shown by FIG. 9 in which the center of gravity of the scale is on the horizontal, balancing the rotating moment due to the dead weight of the scale. In this situation, the contact member 26 applies in the direction of a radius of the rotatable member 3 the tensile elasticity of the tension member 25 to the periphery of the rotatable member 3 so that any unbalanced load possibly exerted on the rotatable member 3 may be effectively reduced. As the scale is subsequently rotated from the horizontal position to the vertical position just below the rotatable member, the tension angle of the tension member 25 gradually decreases. At the position shown in FIG. 10 in which the center of gravity of the scale has reached said position just below the rotatable member, the engaging member 22 is on the remotest position but the tension member 25 and the contact member 26 are on a line along the diameter of the rotatable member 3 as in the situation of FIG. 8 so that the tensile elasticity of the tension member 25 is balanced. No rotating moment is exerted upon the rotatable member 3 and this condition is balanced with the condition of zero rotating moment due to the dead weight of the scale S.

The tensile elasticity of the tension member 25 increases as the engaging member 22 is moved radially away from the center of the rotatable member 3 and thus the engaging member 22 may be controllably moved away radially from the center of the rotatable member 3 in order to maintain the scale well balanced regardless of the drawing board's orientation which may vary between the horizontal orientation and the vertical orientation.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A scale balancing device incorporated into a scale manipulating head of a drawing machine comprising:

a bearing base plate provided in the scale manipulating head;

a scale rotating shaft rotatably supported in said bearing base plate;

a rotatable member having a rotational radius and being rotatable concentrically and integrally with said scale rotating shaft;

an engaging member provided position-adjustably in a direction of the rotational radius of said rotatable member;

a tension member having two ends, one end of said tension member being connected to said engaging member and having a tensile elasticity;

a biasing mechanism provided on said bearing base plate and having two ends, one end of said biasing mechanism being connected to the other end of said tension member; and the other end of said biasing mechanism bearing against said rotatable member under the tensile elasticity of said tension member.

2. The scale balancing device incorporated into a scale manipulating head of a drawing machine as recited by claim 1, wherein the engaging member is provided position-adjustably in a direction of the rotational radius of the rotatable member from the center of said rotatable member.

3. The scale balancing device incorporated into a scale manipulating head of a drawing machine as recited by claim 1 or 2, wherein the engaging member is position-adjustably movable as a threaded shaft provided on the rotatable member is rotated.

4. The scale balancing device incorporated into a scale manipulating head of a drawing machine as recited by claim 3, wherein the rotatable member includes a guide frame within which there is the engaging member adapted to be position-adjustably guided as the threaded shaft is rotated.

5. The scale balancing device incorporated into a scale manipulating head of a drawing machine as recited by claim 1, wherein the tension member comprises a tension spring and wire secured at one end to a wire anchoring means provided adjacent the center of the rotatable member and adapted to be engaged at its intermediate portion with the engaging member.

6. The scale balancing device incorporated into a scale manipulating head of a drawing machine as recited by claim 1, wherein the biasing mechanism comprises an one-piece member having one end subjected to the tensile elasticity of the tension member and the other end bearing against the periphery of the rotatable member.

7. A scale balancing device incorporated into a scale manipulating head of a drawing machine comprising:

a bearing base plate provided in the scale manipulating head;

a scale rotating shaft rotatably supported in said bearing base plate;

a rotatable member having a rotational radius and being rotatable concentrically and integrally with said scale rotating shaft;

an engaging member provided position-adjustably in a direction of the rotational radius of said rotatable member;

a tension member having two ends, one end of said tension member being connected to said engaging member and having a tensile elasticity;

a biasing mechanism provided on said bearing base plate and having two ends, one end of said biasing mechanism being connected to the other end of said tension member;

the other end of said biasing mechanism bearing against said rotatable member under the tensile elasticity of said tension member; and a scale rotational angle indexing mechanism consisting of an indexing plate having grooves therein and an indexing detent adapted to be received in any one of said grooves to lock the scale at predetermined angular intervals, in which locking force provided by engagement of said grooves and said detent can be maintained by the scale balancing force.

8. The scale balancing device incorporated into a scale manipulating head of a drawing machine as recited by claim 7, wherein the engaging member is provided position-adjustably in a direction of the rotational radius of the rotatable member from the center of the rotatable member.

9. The scale balancing device incorporated into a scale manipulating head of a drawing machine as recited by claim 7 or 8, wherein the engaging member is position-adjustably movable as the threaded shaft provided on the rotatable member is rotated.

10. The scale balancing device incorporated into a scale manipulating head of a drawing machine as recited by claim 9, wherein the rotatable member includes a guide frame within which the engaging member is position-adjustably guided as the threaded shaft is rotated.

11. The scale balancing device incorporated into a scale manipulating head of a drawing machine as recited by claim 7, wherein the tension member comprises a tension spring and wire secured at one end to a wire anchoring means provided adjacent the center of the rotatable member and adapted to be engaged at its intermediate portion with the engaging member.

12. The scale balancing device incorporated into a scale manipulating head of a drawing machine as recited by claim 7, wherein the biasing mechanism comprises an one-piece member having one end subjected to the tensile elasticity of the tension member and the other end bearing against the periphery of the rotatable member.

13. A scale balancing device incorporated into a scale manipulating head of a drawing machine comprising:

a bearing base plate provided in the scale manipulating head;

a scale rotating shaft rotatably supported in said bearing base plate;

a rotatable member having a rotational radius and being rotatable concentrically and integrally with said scale rotating shaft;

an engaging member provided position-adjustably in a direction of the rotational radius of said rotatable member;

a tension member having two ends, one end of said tension member being connected to said engaging member and having a tensile elasticity;

a biasing mechanism provided on said bearing base plate and having two ends, one end of said biasing mechanism being connected to the other end of said tension member;

the other end of said biasing mechanism bearing against said rotatable member under the tensile elasticity of said tension member; and a scale rotational angle indexing mechanism for locking the scale at predetermined angular intervals, in which a lever provided along the scale rotating shaft is bent for operation of said lever without any mechanical interference with said engaging member.

14. The scale balancing device incorporated into a scale manipulating head of a drawing machine as recited by claim 13, wherein the lever provided along the scale rotating shaft is pivotally supported by a diameter-reduced portion inside the hollow scale rotating shaft and bent at a point above said dimaeter-reduced portion of the rotatable shaft serving as the pivot so that said lever may operate without any mechanical interference with said engaging member.

15. The scale balancing device incorporated into a scale manipulating head of a drawing machine as recited by claim 13 or 14, wherein the engaging member is provided position-adjustably in a direction of the rotational radius of the rotatable member from the center of said rotatable member.

16. The scale balancing device incorporated into a scale manipulating head of a drawing machine as recited by claim 15, wherein the engaging member is position-adjustably movable as the threaded shaft is rotated.

17. The scale balancing device incorporated into a scale manipulating head of a drawing machine as recited by claim 16, wherein the rotatable member includes the guide frame within which the engaging member is position-adjustably guided as the threaded shaft is rotated.

18. The scale balancing device incorporated into a scale manipulating head of a drawing machine as recited by claim 13, wherein the tension member comprises a tension spring and wire secured at one end to a wire anchoring means provided adjacent the center of the rotatable member and adapted to be engaged at its intermediate portion with the engaging member.

19. The scale balancing device incorporated into a scale manipulating head of a drawing machine as recited by claim 13, wherein the biasing mechanism comprises an one-piece member having one end subjected to the tensile elasticity of the tension member and the other end bearing against the periphery of the rotatable member.

* * * * *